US008616335B1

(12) United States Patent
Mosier

(10) Patent No.: US 8,616,335 B1
(45) Date of Patent: Dec. 31, 2013

(54) LADDER SECURING APPARATUS

(76) Inventor: Tim Mosier, Hope, AR (US)

( * ) Notice: Subject to any disclaimer, the term of this patent is extended or adjusted under 35 U.S.C. 154(b) by 0 days.

(21) Appl. No.: 13/155,703

(22) Filed: Jun. 8, 2011

(51) Int. Cl.
*E06C 7/00* (2006.01)
*A47G 1/17* (2006.01)

(52) U.S. Cl.
USPC ..... 182/107; 248/206.5

(58) Field of Classification Search
USPC ..... 108/107; 248/206.5
See application file for complete search history.

(56) References Cited

U.S. PATENT DOCUMENTS 2,691,479 A * 10/1954 Sharp ..... 182/109
3,046,833 A * 7/1962 Harvey et al. ..... 352/221
3,109,619 A * 11/1963 Krug et al. ..... 248/690
3,486,580 A * 12/1969 Walter et al. ..... 182/214
3,858,684 A * 1/1975 Goings ..... 182/207
4,444,291 A * 4/1984 McPherson ..... 182/214
4,907,769 A * 3/1990 Hunley et al. ..... 248/185.1
6,926,241 B2 * 8/2005 Garrett ..... 248/229.1
6,957,826 B1 * 10/2005 MacKarvich ..... 280/491.3
2005/0139559 A1 6/2005 Trusty et al.
2008/0289904 A1 11/2008 Heiduk
2011/0315476 A1 * 12/2011 Clarkson ..... 182/107

OTHER PUBLICATIONS

Magnets for pilot ladders (for clamping, positioning and holding), PTR Holland B.V. on-line catalog, www.ptrholland.com, accessed on Apr. 5, 2011.

* cited by examiner

*Primary Examiner* — Alvin Chin Shue
(74) *Attorney, Agent, or Firm* — J. Charles Dougherty

(57) ABSTRACT

An apparatus to secure a ladder to a ferromagnetic work surface, such as a metal storage tank, comprises a pair of brackets removably attached near the top of the ladder. The brackets are hinged to magnet mounts, which each hold a permanent magnet that releasably holds the ladder in place against the work surface. The apparatus prevents the ladder from slipping while a worker is climbing the ladder or while working from the ladder.

5 Claims, 2 Drawing Sheets

LADDER SECURING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention is directed to an apparatus for securing a ladder in a desired position, and in particular to such an apparatus that is used to secure a ladder to a ferromagnetic surface.

Portable ladders, and in particular the leaning-type extension ladders usually constructed of aluminum or fiberglass, are well known in the art. Such ladders are commonly employed for many industrial applications where a worker much reach a relatively high area in order to perform, for example, a maintenance or repair operation.

In order to prevent slippage and resulting injury due to a fall, it is a common safety practice to tie or otherwise secure the top of a portable leaning-type ladder to the adjacent surface during its use. In certain applications, however, it is not practical to tie or secure the ladder to the adjacent surface. One common such application encountered is when a worker uses a portable ladder to reach a relatively high point on a large storage tank, such as are commonly used to store oil and other industrial liquids. Various points on these storage tanks must be reached for a number of reasons, including maintenance and painting. The sides of these tanks are typically smooth, and contain no readily available means by which the top of a ladder may be secured. As a result, workers have no alternative but to use these ladders without securing them in place, which creates a significant safety risk for the worker. The risk to the worker is particularly great since painting and related work on a tank may require the worker to lean sideward from the ladder, increasing the risk that the ladder may slip during use.

It may also be seen that tying or other common means to secure the top of a portable, leaning-type ladder to a surface requires that a worker reach the top of the ladder before the ladder may be secured in place. Thus the worker is at risk until the worker reaches the top of the ladder and is able to complete the operation of securing the ladder in place. The movements necessary for the worker to secure the ladder in place may themselves lead to a slippage of the ladder, thus creating a risk associated with the very act intended to increase the safety of the further use of the ladder.

It may be seen from the above discussion that an apparatus for securing a portable ladder when there is no readily available surface to secure the top of the ladder in place would be highly desirable. Likewise, a means of securing the top of a portable ladder in place that does not require the worker to first climb the ladder would also be highly desirable.

References mentioned in this background section are not admitted to be prior art with respect to the present invention.

BRIEF SUMMARY OF THE INVENTION

The present invention is directed to an apparatus to secure a ladder in place to a ferromagnetic surface, such surfaces including but not limited to metal storage tanks. The invention does not require the worker to climb the ladder before securing the ladder in place, thus avoiding the risk of fall during the process of climbing and securing the ladder.

In a first aspect, the invention is directed to a ladder safety apparatus, comprising first and second bracket plates wherein the first and second bracket plates are parallel and at least one of the first and second bracket plates comprises a flange comprising an elongated hinge bolt opening, first and second bracket sidewalls wherein the first and second bracket sidewalls are parallel to each other and perpendicular to the first and second bracket plates, at least two clamping bolts passing through the first and second bracket plates and removably and securely attaching the apparatus to the ladder, a magnet mount, a hinge bolt rotatably connecting the magnet mount to the flange through the elongated hinge bolt opening, and a magnet attached to the magnet mount.

In a second aspect, the invention is directed to a ladder securing apparatus to secure a ladder to a work surface, comprising a bracket attachable to the ladder, wherein the bracket comprises first and second bracket sides, and the bracket further comprises a bracket flange; a magnet mount hingeably connected to the bracket flange; and a magnet attached to the magnet mount such that a magnetic surface of the magnet may extend outwardly from the bracket and magnet mount such that when the bracket is attached to the ladder the magnetic surface of the magnet may connect to the work surface.

In a third aspect, the invention is directed to a ladder comprising at least two stringers; a plurality of rungs; at least two brackets, wherein each of the brackets is removably attachable to one of the at least two stringers, wherein each bracket comprises first and second bracket sides, and each bracket further comprises a bracket flange; a mount rotationally connected to the bracket flange; and a permanent magnet attached to the mount.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Figure 1:
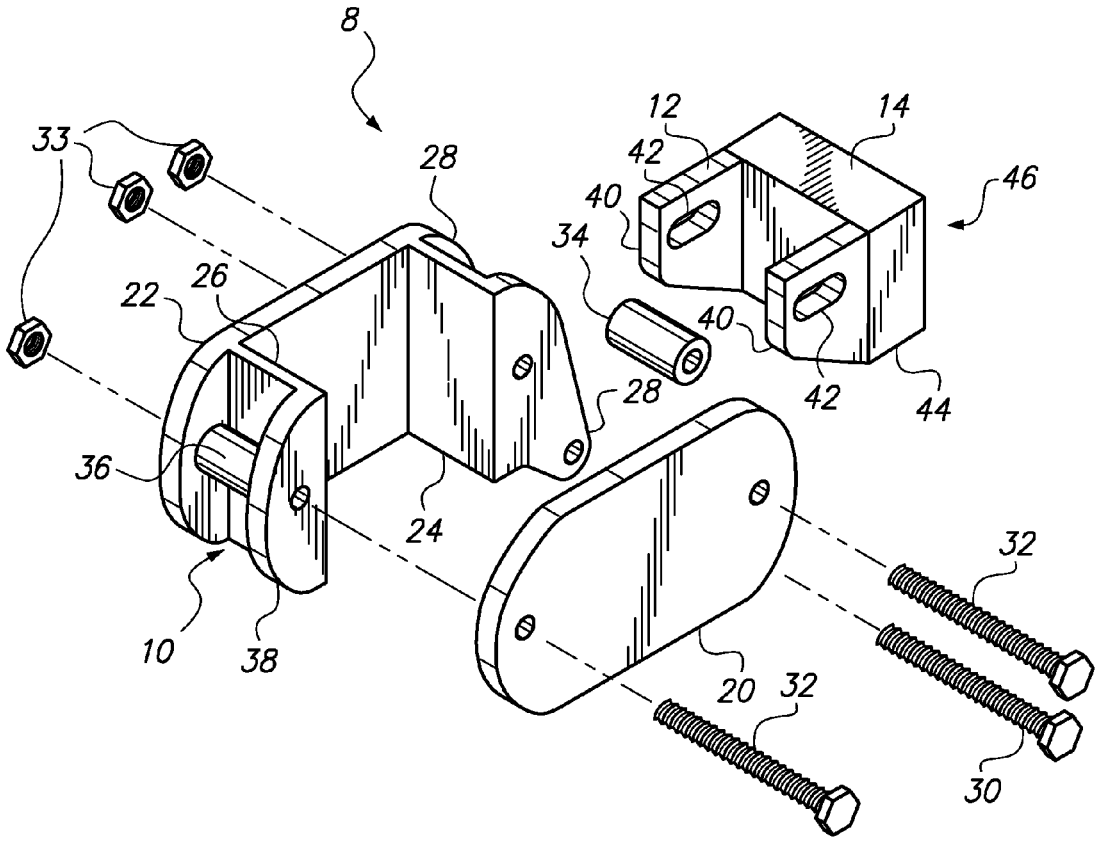
FIG. 1 is an exploded, perspective view of a preferred embodiment of a bracket according to a preferred embodiment of the invention.
Figure 2:
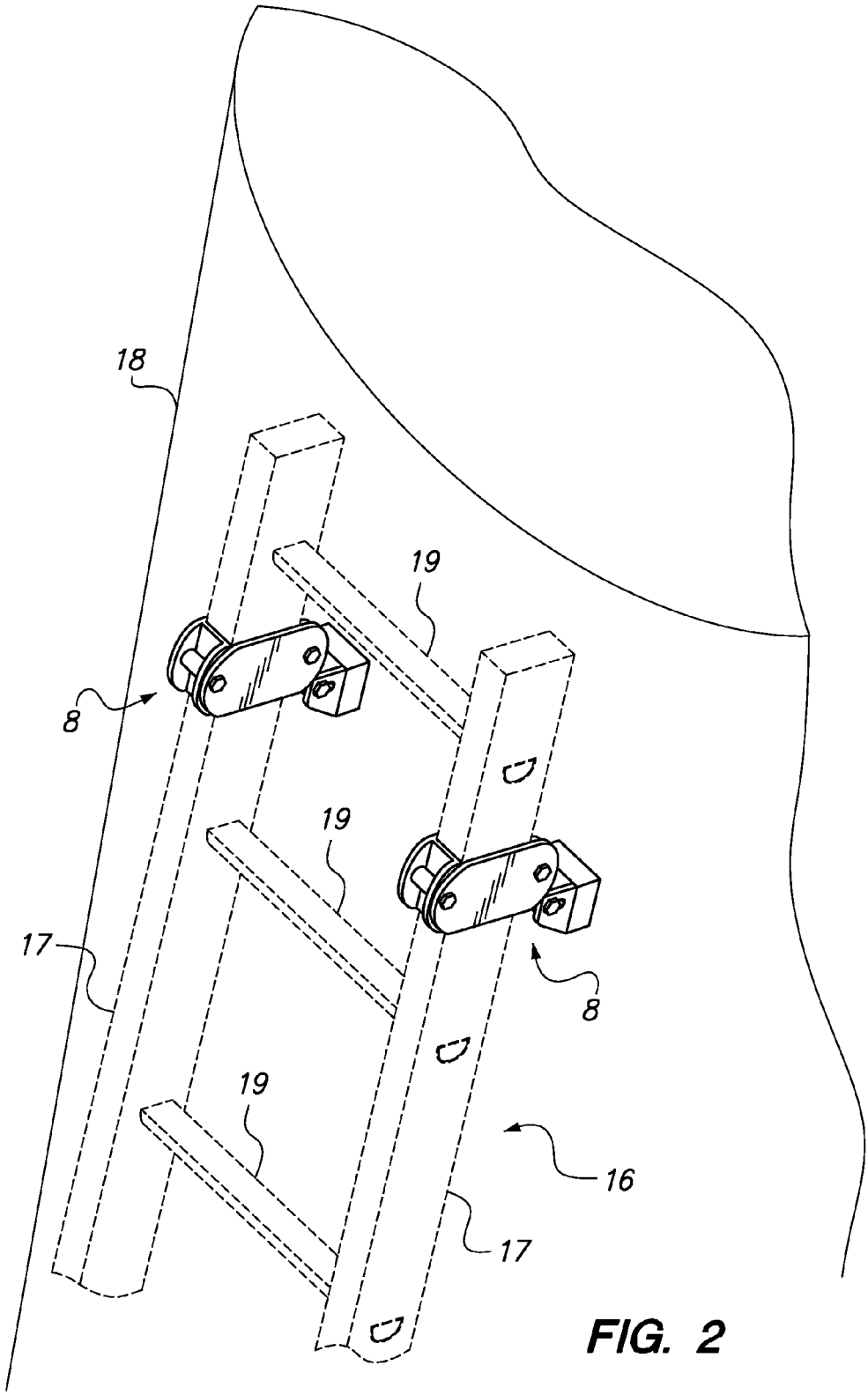
FIG. 2 is a drawing depicting the use of a preferred embodiment of the invention in connection with a leaning-type ladder employed during maintenance performed at a metal storage tank.

With reference to FIG. 1, an attachment 8 according to a preferred embodiment of the present invention may be described. As illustrated in FIG. 2, two such attachments 8 are used to secure a ladder 16 to a storage tank 18 or other ferromagnetic surface.

Each attachment 8 is formed of a bracket 10, a magnet mount 12, and a magnet 14. Bracket 10 includes two plates that form its longer sides, first bracket plate 20 and second bracket plate 22. These plates are fitted, as shown in FIG. 2, to stringers 17 of ladder 16 such that they are perpendicular to rungs 19 of ladder 16.

Second bracket plate 22 has first sidewall 24 and second sidewall 26 extending therefrom, with first bracket plate 20 pressed against the extending ends of first sidewall 24 and second sidewall 26, resulting in a partially enclosed space sized to receive a stringer 17 or ladder 16. Flange wing 28 extends from first sidewall 24, parallel to second bracket plate 22. Likewise, support wing 38 extends from second sidewall 26, also parallel to second bracket plate 22.

Bracket plate bolts 32 extend through first bracket plate 20, one each passing through flange wing 28 and support wing 38, then passing through second bracket plate 22 and being secured with a nut 33. In the preferred embodiment, hinge bolt channel 34 and bracket plate bolt channels 36 provide a protected channel through which hinge bolt 30 and bracket plate bolts 32, respectively, may pass, although these may be omitted in alternative embodiments.

Bracket plate bolts 32 hold bracket 10 locked onto a stringer 17 of ladder 16 by means of the friction that results by compression of first bracket plate 20 and second bracket plate 22 against stringer 17. By loosening or removing bracket plate bolts 32 and the corresponding nuts 33, bracket 10 may be repositioned or removed from stringer 17. It will be seen that it is necessary to remove bracket plate bolts 32 in order to reposition bracket 10 beyond the adjacent rungs 19 of ladder 16.

Magnet mount 12 includes magnet mount wings 40, through which hinge bolt 30 passes, thereby securing magnet mount 12 to bracket 10 in a fashion that, by loosening or tightening hinge bolt 30, allows magnet mount 12 to pivot with respect to bracket 10. Although various ways of connecting magnet 14 to magnet mount 12 may be employed in alternative embodiments within the scope of the invention, in the preferred embodiment magnet 14 is housed within magnet cup 44, which encloses magnet 14 on all sides except for magnetic surface 46 of magnet 14.

Magnet 14 is preferably a permanent magnet formed of a "hard" ferromagnetic material, such as alnico or hard ferrites. It is aligned in magnet cup 44 such that magnetic surface 46 provides a magnetic attraction towards a nearby ferromagnetic surface, such as storage tank 18. In the preferred embodiment, an alnico permanent magnet with about a 70 lb. effective pull is employed, although various other types of magnets as are known in the art may be substituted in alternative embodiments.

It may be seen that the alignment of magnetic surface 46 of magnet 14 may be adjusted with respect to bracket 10 by loosening and then retightening hinge bolt 30. When loosened, magnet mount 12 may pivot with respect to bracket 10, thereby allowing alignment of magnetic surface 46 as desired by the worker employing attachment 8. In addition, in the preferred embodiment hinge bolt slots 42 in magnet mount wings 40 are elongated. This allows the worker greater flexibility in the positioning of magnet mount 12 with respect to bracket 10 when hinge bolt 30 is loosened.

The various parts of bracket 10 and magnet mount 12 are preferably formed of steel or another sufficiently rigid metal to provide a secure hold to ladder 16 without breaking during use. The various parts that are permanently connected may preferably be welded together. In alternative embodiments, other materials could be used, such as a resin of sufficient strength. In particular in the case of resin parts, it may be desirable to form multiple parts as described above as an integrated, molded whole.

The structure of a preferred embodiment of attachment 8 having been described, a method of using attachments 8 in order to hold a ladder 16 safely in place may be described with reference to FIG. 2. In this example, a worker desires to reach a high area on the side of a metal storage tank 18, such as for painting or other maintenance reasons. In order to do so, the worker employs ladder 16 to reach the desired height. Two attachments 8 will be employed to hold the top of ladder 16 in place once ladder 16 is leaned against storage tank 18.

In order to connect attachments 8 to ladder 16, bracket plate bolts 32 are removed from attachments 8. This allows the worker to place first bracket plate 20 and second bracket plate 22 of each attachment 8 on opposite sides of the two stringers 17 of ladder 16. It is necessary to remove bracket plate bolts 32 rather than simply loosen them since otherwise bracket 10 could not be slipped onto stringers 17 due to the presence of rungs 19. Complete removal of bracket plate bolts 32 would not be necessary if bracket 10 is positioned at a point on stringers 17 that is above the top rung 19 of ladder 16.

Preferably, both brackets 10 are positioned at points on stringers 17 of ladder 16 that are equidistant from the top of ladder 16, directly across from each other. It may be seen, however, that uneven placement of brackets 10 may be desirable if an uneven work surface were lying underneath ladder 16. Since the brackets 10 are movable to any location on stringers 17, the preferred embodiment allows the worker to compensate for this occurrence and still provide a safely secured position for ladder 16.

In the typical application of climbing a storage tank 18 as depicted in FIG. 2, the inventor has found that positioning brackets 10 of attachments 8 approximately 12" from the top of ladder 16 works well. The ideal positioning may be varied, however, due to a number of factors, including the length of the ladder, the angle the ladder forms with the horizontal, and the presence or absence of ferromagnetic material at various points along the work surface.

Once brackets 10 of attachments 8 are securely connected to stringers 17 of ladder 16, magnet mount 12 may be rotated into proper position with respect to bracket 10 by loosening and then retightening hinge bolt 30. It will be understood that if a vertical surface such as storage tank 18 is the work surface against ladder 16 will lean, then magnet mounts 12 should be positioned such that magnetic surface 46 of magnets 14 will be as closely vertical as possible when the ladder is placed into the desired position against storage tank 18. Hinge bolt slots 42 allow for additional fine adjustment of the position of magnetic surface 46, both as to the angle of magnetic surface 46 with respect to ladder 16, and also with respect to the degree to which magnetic surface 46 extends outward from stringers 17. Thus, for example, if the worker determines after placing ladder 16 in to position that magnetic surface 46 does not extend quite far enough to make contact with storage tank 18, or extends slightly too far and thereby prevents the top of ladder 16 to properly rest in position against storage tank 18, then proper adjustments may be made without the necessity of repositioning brackets 10.

Once ladder 16 is positioned with the top of ladder 16 resting against storage tank 18 and magnetic surfaces 46 of magnets 14 just in contact with storage tank 18, it may be seen that the ladder will be held safely at its top such that the worker may climb the ladder and work from the ladder without the risk of ladder 16 slipping during use. Once the work at a particular location is completed, the worker may climb down ladder 16 and, with a simple twisting motion of ladder 16, disengage first one then another of magnets 14 from storage tank 18. By using the top of ladder 16 against storage tank 18 as a fulcrum and stringers 17 as a lever, the worker is able to apply sufficient leverage to sufficiently overcome the magnetic attraction of magnets 14 to storage tank 18 and move ladder 16.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

When a Markush group or other grouping is used herein, all individual members of the group and all combinations and subcombinations possible of the group are intended to be individually included in the disclosure.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims.

In general the terms and phrases used herein have their art-recognized meaning, which can be found by reference to standard texts, journal references and contexts known to those skilled in the art. The preceding definitions are provided to clarify their specific use in the context of the invention.

All patents and publications mentioned in the specification are indicative of the levels of skill of those skilled in the art to which the invention pertains. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention as set forth in the appended claims.

The invention claimed is:

1. A ladder securing apparatus to secure a ladder to a work surface, comprising:

a. a bracket attachable to the ladder, wherein the bracket comprises a first flat plate, a second flat plate, a first sidewall extending inwardly from and perpendicular to the first flat plate, a second sidewall extending inwardly from and perpendicular to the second flat plate, and a bracket flange comprising a bracket flange opening, wherein the bracket flange comprises a first and second bracket flange wing, wherein the first bracket flange wing comprises a section of the second flat plate and the second bracket flange wing extends from the first sidewall parallel to the second plate, parallel to the first bracket flange wing and the second flat plate;

b. a magnet mount comprising a magnet mount opening;

c. a hingepin passing through the bracket flange opening and magnet mount opening to connect the bracket flange and magnet mount, wherein the hingepin is selectably adjustable to alter an angle formed between the bracket flange and magnet mount, and further wherein at least one of the bracket flange opening and magnet mount opening is an elongated slot, wherein the hingepin is selectably adjustable to slide the magnet mount toward or away from the bracket;

d. a magnet attached to the magnet mount such that a magnetic surface of the magnet may extend outwardly from the bracket and magnet mount such that when the bracket is attached to the ladder the magnetic surface of the magnet may connect to the work surface;

e. a cylindrical hingepin channel passing interior to and between the first and second bracket flange wings, wherein the hingepin also passes through the hingepin channel, and wherein at least one of the first and second bracket flange wings comprises the bracket flange opening and wherein the hingepin extends perpendicularly through the first and second bracket flange wings;

f. a support wing extending from the second sidewall and parallel to the first bracket plate; and g. first and second bolts passing through the first and second bracket plates and thereby clamping the first and second bracket plates together, wherein the first bolt passes through the first and second bracket wings and through the first bracket plate, and the second bolt passes through the second bracket plate, the support wing, and the first bracket plate.

2. The apparatus of claim 1, wherein said magnet mount comprises first and second magnet mount wings extending parallel to the first and second bracket plates, and at least one of the first and second magnet mount wings comprises the magnet mount opening.

3. The apparatus of claim 2, wherein the hingepin is a hingepin bolt and nut, and wherein the magnet mount opening is elongated whereby the position of the magnet mount with respect to the bracket is adjustable by sliding the magnet mount with respect to the first and second bracket wings by loosening and tightening the hingepin bolt and nut.

4. The apparatus of claim 3, wherein the magnet mount further comprises a cup housing the magnet such that the magnetic surface remains exposed.

5. A ladder securing apparatus to secure a ladder to a work surface, comprising:

a. a bracket attachable to the ladder, wherein the bracket comprises first and second bracket sides, the first bracket side comprises a first flat plate, the second bracket side comprises a second flat plate and first and second sidewalls extending inwardly from and perpendicularly to the second flat plate, a support wing extending from the second sidewall and parallel to the first bracket plate, and the bracket further comprises a bracket flange, wherein the bracket flange comprises a first and second bracket flange wing, wherein the first bracket flange wing comprises a section of the second flat plate and the second bracket flange wing extends from the first sidewall parallel to the second plate, parallel to the first bracket flange wing and the second flat plate;

b. a magnet mount hingeably connected to the bracket flange;

c. first and second bolts connecting the first and second bracket sides together, the first bolt passing through the first and second bracket wings and through the first bracket plate, and the second bolt passing through the second bracket plate, the support wing, and the first bracket plate; and d. a magnet attached to the magnet mount such that a magnetic surface of the magnet may extend outwardly from the bracket and magnet mount such that when the bracket is attached to the ladder the magnetic surface of the magnet may connect to the work surface.

* * * * *